US006514067B1

(12) United States Patent
Suzuki et al.

(10) Patent No.: US 6,514,067 B1
(45) Date of Patent: Feb. 4, 2003

(54) ROTARY TROWEL FOR USE IN THE MOLDING OF CERAMICS AND METHOD FOR PRODUCTION THEREOF

(75) Inventors: Yoshihiko Suzuki, Ichikawa (JP); Seizo Kato, Mizunami (JP); Atsuo Ishikawa, Tokyo (JP)

(73) Assignee: Vantico Inc., Brewster, NY (US)

( * ) Notice: Subject to any disclaimer, the term of this patent is extended or adjusted under 35 U.S.C. 154(b) by 0 days.

(21) Appl. No.: 09/744,228

(22) PCT Filed: Jul. 15, 1999

(86) PCT No.: PCT/EP99/05010

§ 371 (c)(1),
(2), (4) Date: Jan. 22, 2001

(87) PCT Pub. No.: WO00/05045

PCT Pub. Date: Feb. 3, 2000

(30) Foreign Application Priority Data

Jul. 24, 1998 (JP) ..... 10-225222

(51) Int. Cl.[7] ..... B28B 1/02

(52) U.S. Cl. ..... 425/459; 264/219; 425/267

(58) Field of Search ..... 425/459, 469, 425/267; 264/219

(56) References Cited

U.S. PATENT DOCUMENTS 4,504,283 A * 3/1985 Charvat
4,681,600 A * 7/1987 Rhoades et al.

FOREIGN PATENT DOCUMENTS

EP 181493 * 5/1986
FR 2602708 * 2/1988

* cited by examiner

*Primary Examiner*—James P. Mackey
(74) *Attorney, Agent, or Firm*—Proskauer Rose LLP; Kristin H. Neuman

(57) ABSTRACT

A rotary trowel (1) for use in the molding of ceramics (15) comprising a trowel matrix (2) and a trowel surface (3) provided on said trowel matrix (2) so as to make contact with a raw clay composition (15) and calender the raw clay composition (15), characterized in that said trowel surface (3) is formed by providing an epoxy resin composition containing an abrasion-resistant material on the inner surface of a casting mold (6).

11 Claims, 4 Drawing Sheets

ROTARY TROWEL FOR USE IN THE MOLDING OF CERAMICS AND METHOD FOR PRODUCTION THEREOF

FIELD OF THE INVENTION

The present invention relates to a rotary trowel for molding ceramics suitable for use in the molding of various ceramic products such as dish, bowl and the like by means of a jigger.

DESCRIPTION OF THE PRIOR ART

Heretofore, the method of rotary trowel type molding which comprises feeding a raw clay composition into gap between a rotatable gypsum mold attached to the shaft of a jigger and a rotary trowel provided above the gypsum mold so as to rotate, and calendering the raw clay composition to form a ceramic product on the surface of the trowel has been adopted largely.

Since the rotary trowel used in the above method comes into contact with the raw clay composition while rotating at a high speed (usually, about 300 rpm or above), the trowel surface is required to have an abrasion resistance and a smoothness enough to lessen the abrasion loss and improve the quality of product. Especially in the recent years, it is intensely desired to pattern the outer surface of ceramics finely, in proportion to which the trowel surface is readily lost by abrasion and lifetime of the rotary trowel is shortened. As a result, abrasion-resistance and smoothness of trowel surface have very important meanings. Further, in cases where the trowel surface must be patterned, the material constituting the trowel surface is required to have a high easiness of molding enough to form the concave-convex pattern easily and a high security of molding enough to form the fine pattern more exactly.

In the prior rotary trowel, a pattern is formed on the trowel surface by a mechanical fabrication (cutting or the like), or by mechanically fabricating a matrix followed by flame spray-coating a molten abrasion-resistant material onto the patterned matrix surface to form a film thereof.

However, mechanical fabrication is sometimes unable to form a fine pattern (that is, fine convexities cannot sometimes be formed by cutting fabrication though concavities can relatively easily be formed thereby), and requires a quite complicated procedure. Further, when the step of flame spraying coating is added thereto, the number of steps increases and a film of uniform thickness becomes difficult to form on the matrix surface, so that no fine pattern can be formed exactly.

SUMMARY OF THE INVENTION

Thus, it is the first problem of the present invention to provide a rotary trowel for use in the molding of ceramics which can retain a high abrasion-resistance and a high smoothness of trowel surface and, even when complicated patterns are given to the trowel surface, can form such patterns easily and exactly.

Further, as a modification of the rotary trowel type calender molding method, there can be referred to the hot trowel method which comprises generating a steam film in gap between the rotary trowel and the raw clay composition by heating the rotary trowel and thereby preventing adhesion of the raw clay composition to the rotary trowel and at the same time retaining a smooth contact between the rotary trowel and the raw clay composition. The rotary trowel used in the hot trowel method is usually heated to a temperature of 80–120° C. by means of a heater or the like, and therefore the material constituting the rotary trowel is required to have a high heat resistance and a high heat conductivity enough to transmit heat to the trowel surface.

Thus, it is the second problem of the present invention to provide a rotary trowel for use in the molding of ceramics which retains a high abrasion-resistance and a high smoothness of trowel surface and, even in cases where complicated patterns are to be formed on the trowel surface, can form such patterns easily and exactly, and is excellent in heat resistance and heat conductivity.

DETAILED DESCRIPTION OF THE PREFERRED EMBODIMENTS

Figure 1:
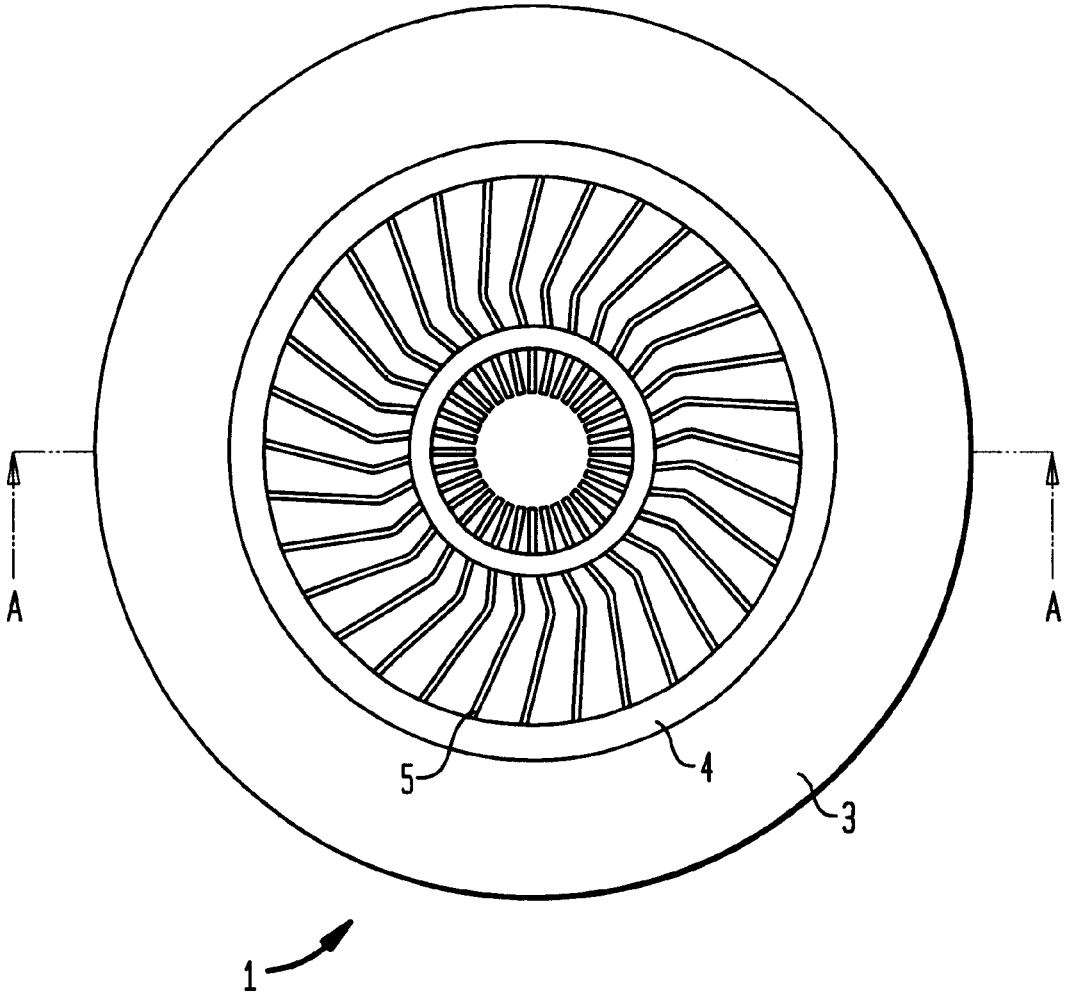
FIG. 1 is a plan view illustrating one example of the rotary trowel for use in the molding of ceramics of the present invention.

The first problem of the present invention mentioned above can be solved by a rotary trowel for use in the molding of ceramics comprising a trowel matrix and a trowel surface provided on the surface of said trowel matrix so as to make contact with a raw clay composition and calender the raw clay composition, characterized in that said trowel surface is formed by providing an epoxy resin composition containing an abrasion-resistant material on the inner surface of a casting mold.

Further, the first problem mentioned above can be solved also by a rotary trowel for use in the molding of ceramics comprising a trowel matrix and a trowel surface provided on said trowel matrix so as to make contact with a raw clay composition and calender said raw clay composition, said trowel surface being formed from an epoxy resin composition comprising a polyfunctional aminoepoxy resin which is a polyglycidyl derivative of an aminophenol having a viscosity of 3,000 centipoises or less as measured at 25° C. and an abrasion-resistant material having a particle size of 200 $\mu$m or less and a particle size distribution represented by a uniformity coefficient of 10 or above and a curvature coefficient of 10 or below as determined from a cumulative particle size curve, wherein proportion of a fraction of said abrasion-resistant material having a particle size of 10 $\mu$m or less to the total abrasion-resistant material is 15–50% by weight, proportion of a fraction of said abrasion-resistant material having a particle size of 1 μm or less to the total abrasion-resistant material is 30% by weight or less, and the ratio (by weight) of said polyfunctional aminoepoxy resin to said abrasion-resistant material (polyfunctional aminoepoxy resin:abrasion-resistant material) in said epoxy resin composition is in the range of from 15:85 to 40:60.

Preferably, said abrasion-resistant material is alumina, silica, silicon carbide, mullite, zirconium, silicon nitride or boron nitride.

The second problem of the present invention mentioned above can be solved by a rotary trowel for use in the molding of ceramics comprising a trowel matrix and a trowel surface provided on said trowel matrix so as to make contact with a raw clay composition and calender said raw clay composition, characterized in that said trowel surface is formed from an epoxy resin composition comprising a polyfunctional aminoepoxy resin which is a polyglycidyl derivative of an aminophenol having a viscosity of 3,000 centipoises or less as measured at 25° C. and an abrasion-resistant material having a particle size of 200 μm or less and a particle size distribution represented by a uniformity coefficient of 10 or above and a curvature coefficient of 10 or below as determined from a cumulative particle size curve, wherein proportion of a fraction of said abrasion-resistant material having a particle size of 10 μm or less to the total abrasion-resistant material is 15–50% by weight and proportion of a fraction of said abrasion-resistant material having a particle size of 1 μm or less to the total abrasion-resistant material is 30% by weight or less, and ratio (by weight) of the polyfunctional aminoepoxy resin to the abrasion-resistant material (polyfunctional aminoepoxy resin:abrasion-resistant material) in the epoxy resin composition is in the range of from 15:85 to 40:60, and said trowel matrix is formed from an epoxy resin composition comprising a polyfunctional aminoepoxy resin which is a polyglycidyl derivative of an aminophenol having a viscosity of 3,000 centipoises or less as measured at 25° C. and a metal powder having a particle size of 200 μm or less and a particle size distribution represented by a uniformity coefficient of 10 or above and a curvature coefficient of 10 or as determined from a cumulative particle size curve, wherein proportion of a fraction of said metal powder having a particle size of 10 μm or less to the total metal powder is 15–50% by weight, proportion of a fraction of said metal powder having a particle size of 1 μm or less to the total metal powder is 30% by weight or less, and ratio (by weight) of the polyfunctional aminoepoxy resin to the metal powder (polyfunctional aminoepoxy resin:metal powder) in the epoxy resin composition is in the range of from 15:85 to 40:60. Preferably, said metal powder is powdered aluminum.

Further, it is preferable that a powdered aluminum having a particle size of not smaller than 1 mm and not greater than 10 mm is compounded into said epoxy resin composition forming said trowel matrix in a proportion (epoxy resin composition:powdered aluminum having a particle size of not smaller than 1 mm and not greater than 10 mm, by weight) of from 1:0.5 to 1:3. Further, it is preferable that a self-lubricating material is compounded into the epoxy resin composition forming said trowel surface and/or said trowel matrix. Further, it is preferable that said self-lubricating material is graphite, molybdenum disulfide, fluororesin, mica or talc. Further, it is preferable that a curing agent and/or a curing accelerator is compounded into the epoxy resin composition constituting said trowel surface and/or said trowel matrix.

The second problem of the present invention can be solved also by a method for producing a rotary trowel for use in the molding of ceramics comprising the steps of preparing a casting mold from a master model, forming a trowel surface by coating the inner surface of said casting mold with an epoxy resin composition comprising a polyfunctional aminoepoxy resin which is a polyglycidyl derivative of an aminophenol having a viscosity of 3,000 centipoises or less as measured at 25° C. and an abrasion-resistant material having a particle size of 200 μm or less and a particle size distribution represented by a uniformity coefficient of 10 or above and a curvature coefficient of 10 or below as determined from a cumulative particle size curve, wherein proportion of a fraction of said abrasion-resistant material having a particle size of 10 μm or less to the total abrasion-resistant material is 15–50% by weight, proportion of a fraction of said abrasion-resistant material having a particle size of 1 μm or less to the total abrasion-resistant material is 30% by weight or less, and the ratio (by weight) of said polyfunctional aminoepoxy resin to said abrasion-resistant material (polyfunctional aminoepoxy resin:abrasion-resistant material) in said epoxy resin composition is in the range of 15:85 to 40:60, forming a trowel matrix by casting an epoxy resin composition into the inner space of said casting mold, wherein said epoxy resin composition comprises a polyfunctional aminoepoxy resin which is a polyglycidyl derivative of an aminophenol having a viscosity of 3,000 centipoises or less as measured at 25° C. and a metal powder having a particle size of 200 μm or less and a particle size distribution represented by a uniformity coefficient of 10 or above and a curvature coefficient of 10 or below as determined from a cumulative particle size curve, wherein proportion of a fraction of said metal powder having a particle size of 10 μm or less to the total metal powder is 15–50% by weight and proportion of a fraction of said metal powder having a particle size of 1 μm or less to the total metal powder is 30% by weight or less, and the ratio (by weight) of said polyfunctional aminoepoxy resin to said metal powder (polyfunctional aminoepoxy resin:metal powder) in said epoxy resin composition is in the range of from 15:85 to 40:60, demolding said trowel surface and said trowel matrix from said casting mold, and heating and curing said trowel surface and said trowel matrix.

As has been mentioned above, the rotary trowel for use in the molding of ceramics according to the present invention has a trowel surface formed from an epoxy resin composition filled with a high percentage of a finely powdered abrasion-resistant material, and therefore the trowel surface of the rotary trowel of the invention retains a very high abrasion resistance and a high smoothness, and at the same time the epoxy resin composition can maintain a fluidity even at room temperature enough to be formed in a casting mold and, even when complicated patterns are to be formed on the trowel surface, the epoxy resin composition can diffuse itself into the concavities of such complicated patterns previously formed in the casting mold and can easily and exactly regenerate the pattern on the trowel surface.

Further, in the rotary trowel for use in the molding of ceramics according to the present invention, the trowel matrix is formed from an epoxy resin composition filled with a high percentage of fine metal powder (preferably powdered aluminum) and has a fluidity so that it can easily be molded at room temperature and, at the same time, it is excellent in heat resistance and heat conductivity. Accordingly, the rotary trowel of the present invention is successfully applicable to the hot trowel method, too. Further, since the epoxy resin composition constituting the trowel matrix contains a powdered aluminum having a particle size of not smaller than 1 mm and not greater than 10 mm in a proportion (epoxy resin composition:powdered aluminum having a particle size of not smaller than 1 mm and not greater than 100 mm, by weight) of from 1:0.5 to 1:3, heat conductivity of the epoxy resin can be more enhanced and the period of time necessary for heating prior to the use of the composition can be shortened.

Next, the rotary trowel for use in the molding of ceramics according to the present invention is explained with reference to one example shown in FIG. 1 and FIG. 2. FIG. 1 is a plan view illustrating one example of the rotary trowel for use in the molding of ceramics according to the present invention, and FIG. 2 is A—A line end view of FIG. 1.

Figure 2:
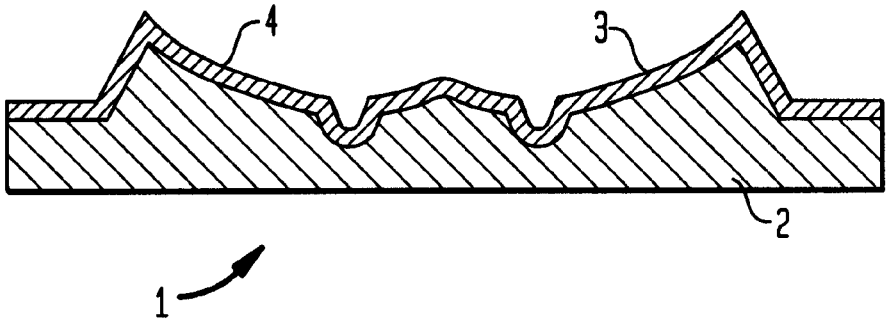
FIG. 2 is an A—A line end view of FIG. 1.
Figure 3:
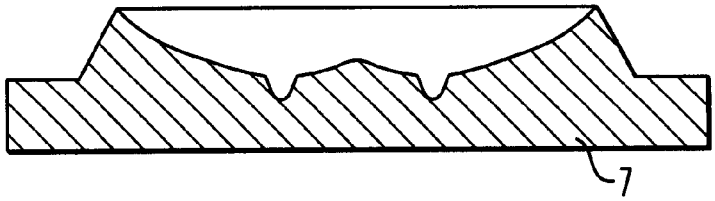
FIG. 3 is a schematic view illustrating one step in the method for producing the rotary trowel for use in the molding of ceramics of the present invention.

As shown in FIG. 2, the rotary trowel 1 for use in the molding of ceramics according to the present example is constructed from trowel matrix 2 and trowel surface 3 provided on the surface of said trowel matrix 2 so as to make contact with a raw clay composition and to calender the raw clay composition.

The trowel matrix 2 is a part constituting the main body of the rotary trowel 1 for use in the molding of ceramics, and it is put to use while being fixed onto a rotary driving part 20 by means of a solidly binding means 21 or the like. The rotary trowel 1 for use in the molding of ceramics shown in the present example is an outer trowel for forming the outer surface of a dish, and the trowel surface 3 has a concavity 4 for forming the outer surface of the dish. However, the rotary trowel for use in the molding of ceramics according to the present invention is not limited to those having such a shape, but it may also be an inner trowel for forming an inner surface of dish or the like, and includes those in which the trowel surface has a wide variety of shapes depending on the shapes of the ceramics to be formed.

The material constituting the trowel matrix 2 is an epoxy resin composition comprising a polyfunctional aminoepoxy resin which is a polyglycidyl derivative of an aminophenol having a viscosity of 3,000 centipoises as measured at 25° C. and a metal powder having a particle size of 200 μm or less and a particle size distribution represented by a uniformity coefficient of 10 or above and a curvature coefficient of 10 or below as determined from a cumulative particle size curve, wherein proportion of a fraction of said metal powder having a particle size of 10 μm or less to the total metal powder is 15–50% by weight, proportion of a fraction of said metal powder having a particle size of 1 μm or less to the total metal powder is 30% by weight or less, and the ratio (by weight) of said polyfunctional aminoepoxy resin to said metal powder (polyfunctional aminoepoxy resin:metal powder) in the epoxy resin composition is in the range of from 15:85 to 40:60.

As said polyfunctional aminoepoxy resin, polyglycidyl derivatives of aminophenols are used. As said aminophenol, aminophenols such as p-aminophenol, m-aminophenol, o-aminophenol and the like, and aminophenols having at least one alkyl substituent on the aromatic ring such as 4-amino-m-cresol, 4-amino-o-cresol, 6-amino-m-cresol, 5-amino-mcresol, 3-ethyl-4-aminophenol, 2-ethyl-4-aminophenol and the like can be referred to. As the polyglycidyl derivative of aminophenol, triglycidyl derivatives of aminophenols are preferred.

The polyfunctional aminoepoxy resin which is a polyglycidyl derivative of aminophenol has a viscosity of 3,000 centipoises or less and preferably 2,500 centipoises or less as measured at 25° C. This is for a reason that polyfunctional aminoepoxy resins having a viscosity exceeding 3,000 centipoises are difficult to compound with a large quantity of metal powder containing fine metal powder. It is also possible to mix other epoxy resins, as minute components, into the polyfunctional aminoepoxy resin which is a polyglycidyl derivative of aminophenol.

Since the rotary trowel for use in the molding of ceramics according to the present invention uses the above-mentioned epoxy resin excellent in heat resistance as a binder for trowel matrix as has been mentioned above, it is successfully usable in the hot trowel method, too.

Although polyfunctional aminoepoxy resins containing aromatic ring, such as triglycidyl derivatives of p-aminophenol and the like, have a fault that they are excessively high in reactivity and exhibit great strain, contraction and heat evolution upon cure, the epoxy resin composition used in the present invention to constitute the trowel matrix is free from such a fault because it is obtained by compounding a large quantity of metal powder having the above-specified particle size distribution into the above-mentioned usual polyfunctional aminoepoxy resins.

Thus, the epoxy resin composition constituting the trowel matrix 2 has a particle size of 200 μm or less and a particle size distribution represented by a uniformity coefficient of 10 or above and a curvature coefficient of 10 or below as determined from a cumulative particle size curve, and contains a metal powder in which the proportion of a fraction having a partide size of 10 μm or less is 15–50% by weight and the proportion of a traction having a particle size of 1 μm or less is 30% by weight or less, both based on the total metal powder.

As the metal powder, powders of various metals such as powdered aluminum, powdered copper, powdered iron and the like can be referred to, for instance. Among these metal powders, powdered aluminum is preferable because it has a high heat conductivity, a thermal expansion coefficient close to that of epoxy resin, a good wettability by epoxy resin, a good state of finished molded surface, and a small specific gravity due to which the weight of molded product can be lessened. In the present example, powdered aluminum was used as the metal powder. Among the powdered aluminums, atomized powder is most preferable because of small specific surface area and good physical entanglement with epoxy resin.

The metal powder of the present invention has a particle size of 200 μm or less, and shows a particle size distribution represented by a uniformity coefficient of 10 or above and a curvature coefficient of 10 or below as determined from a cumulative particle size curve.

A cumulative particle size curve can be depicted according to JIS A-1204 (particle size test). Thus, on a metal powder having a particle size of 200 μm or less of which particle size distribution has been measured with Microtrack 7995 manufactured by Nikkisou K. K., "weight percentage of passing fraction" is measured for every particle size, and the results are plotted on a semi-logarithmic paper by taking the logarithmic scale as particle size and the arithmetic scale as weight percentage of passing fraction based on total sample.

From the cumulative particle size curve obtained above, 60% particle size ($D_{60}$ μm), 30% particle size ($D_{30}$ μm) and 10% particle size ($D_{10}$ μm) are read out, from which uniformity coefficient (UC) and curvature coefficient (UC') are calculated according to the following equations:

$$UC=D_{60}/D_{10}$$

$$UC'=(D_{30})^2/(D_{10}\times D_{60})$$

A greater value of the uniformity coefficient means a broader particle size distribution, and the curvature coefficient quantitatively expresses a particle size distribution when the distribution curve is stepwise. When a metal powder has a particle size distribution represented by a uniformity coefficient of 10 or above and a curvature coefficient of 10 or below, the cumulative particle size curve thereof depicts a smooth line, indicating that the particle size distribution is good. The curvature coefficient is preferably 5 or less and further preferably 1–2.

When the uniformity coefficient is smaller than 10 or the curvature coefficient is out of the above-specified range, a product having a high filler content and a good fluidity is difficult to obtain and a cured molded product excellent in heat conductivity cannot be obtained.

Upper limit of the particle size of the metal powder is 200 μm. If a metal powder containing a fraction having a particle size exceeding 200 μm is used, uniform-dispersibility of metal powder is not good and the skin of molded product is bad in the finished state.

Further, in the metal powder, the proportion of a fraction having a particle size of 10 μm or less is 15–50% by weight and preferably 20–50% by weight; and the proportion of a fraction having a particle size of 1 μm or less is 30% by weight or less and preferably 15% by weight or less. If the proportion of fine powder is too high, viscosity of composition increases to make the compounding work difficult to practice. On the other hand, when particle size distribution of the metal powder conforms to the above-specified ranges, an epoxy resin composition having a good uniform-dispersibility and a high filler content can be obtained.

It is further preferable that specific surface area of the fraction of metal powder having a particle size of 10 μm or less is 6.5 $m^2/g$ or less as measured by BET method or nitrogen adsorption method. This is for the reason that, if the specific surface area exceeds the above-mentioned range, the quantity of epoxy resin required for wetting the surface of metal powder increases to make it difficult to realize a high filler content.

In addition, the ratio (by weight) of the polyfunctional epoxy resin to the metal powder (polyfunctional epoxy resin:metal powder) is in the range of from 15:85 to 40:60, and further preferably from 20:80 to 40:60.

The above-mentioned highness of the content of the metal powder fraction having specified particle size distribution is advantageous in various points. The first advantage is that the contraction rate upon cure is small, so that the master model (original model of mold) can be transferred with a high fidelity. The second advantage is that the cured product has a high conductivity and at the same time a small linear expansion coefficient, which makes the product less strained and more long-keeping. The third advantage is that the surface and the inner portions are evenly heated, which prevents cracking of the product. The fourth advantage is that heat dissipation is good, which brings about a rapid descent of temperature and an easiness of large-scale casting. The fifth advantage is that the epoxy resin composition itself has a high heat conductivity, which makes the temperature distribution uniform at the time of cure, so that the necessity of stepwise heating is eliminated at the time of cure and the procedure of curing is made easier to practice.

Further, the epoxy resin composition preferably contains a curing agent. The curing agents which can be used include, for instance, alicyclic amines, aliphatic amines, aromatic amines, polyamines such as dicyandiamide and the like; modified polyamines such as dimer acidmodified polyamine (polyamide), ketone-modified polyamine (ketimine), epoxide-modified polyamine (epoxy adduct), thiourea adduct-modified polyamine, Mannich-adduct modified polyamine, Michael-adduct modified polyamine and the like; acid anhydrides such as alicyclic acid anhydride, aliphatic acid anhydride, aromatic acid anhydride, halogeno-acid anhydride and the like; polyphenols such as novolak type phenolic resin and the like; polymercaptans; isocyanates; boron trifluoride complexes; imidazoles; etc. Of these curing agents, the use of aliphatic amines, dimer acid-modified polyamines and polymercaptans makes it possible to carry out a cold cure.

Compounding ratio of the curing agent is usually 0.6–1.3 equivalents and preferably 0.7–1.2 equivalents per equivalent of epoxy group of epoxy resin. When the compounding ratio is out of this range, the cured molded product is insufficient in heat resistance.

Further, the epoxy resin composition preferably contains a curing accelerator. The curing accelerators which can preferably be used include, for instance, imidazoles and derivatives thereof such as 2-ethyl-4-methylimidazole, 1-cyanoethyl-4-methylimidazole and the like; tertiary amines such as trisdimethylaminomethyl-phenol, 2,4,6-tris (dimethylamino)phenol and the like; dimethylcyclohexylamine; boron trifluoride monoethylamine; etc. The use of these curing accelerators makes it possible to carry out a cold cure and to shorten the curing time. The quantity of the curing accelerator is usually 0.3–6 parts by weight per 100 parts by weight of epoxy resin. epoxy resin composition usually has a viscosity of 500,000 centipoises or less and preferably 250,000 centipoises or less as measured at 25° C. The composition has a satisfactory fluidity suitable for a large-scale casting, in spite of the large quantity of metal powder contained therein. The procedure of curing is simple, and the cured product obtained therefrom is superior in heat conductivity and heat resistance. Further, the composition can be cured by the process of cold casting so far as a proper curing agent is used. Further, the composition can also be heat-cured, and in this case, no stepwise heating is required but a mere one-step heating from 50° C. to 150° C., for instance, is enough for its cure, due to which the procedure of curing can be simplified.

The molded product obtained by curing the epoxy resin composition has a high heat conductivity of $2.5\times10^{-3}$ cal/cm.sec.° C. or above, making contrast to the prior ones of which it heat conductivity is $2.0\times10^{-3}$ cal/cmsec.° C. or below. Further, the cured molded product has a high heat resistance, and the heat distortion temperature (HDT) under load thereof is all 200° C. or above and the glass transition temperature (Tg) thereof is 170° C. or above. The linear expansion coefficient is $3.5\times10^{-5}$ or below, and the rate of contraction upon cure is in the range of from −0.05 to +0.05%.

The trowel surface 3 is a part provided on the surface of trowel matrix 2 for the purpose of making contact with a raw clay composition and calendering the raw clay composition. In the present example, fine pattern 5 (many convex parts) is formed on the surface of trowel surface 3, as shown in FIG. 1.

As mentioned later in the paragraph describing the production method, the pattern 5 has been transferred from many convex parts (not shown in the drawing) formed on a master model, and the trowel surface of the rotary trowel for use in the molding of ceramics according to the present invention is a trowel surface having a high abrasion resistance and characterized in that, even if the pattern to be formed thereon is a fine pattem, it can regenerate the pattern by the method of molding easily and exactly without any complicated mechanical fabrication, unlike prior trowels. Accordingly, since the pattern is transferred, not only such convex parts as shown in the present example but concave parts or combinations of convex and concave parts can also be formed easily and exactly.

The materials from which the above-mentioned trowel surface 3 can be formed are epoxy resin compositions comprising a polyfunctional aminoepoxy resin which is a polyglycidyl derivative of an aminophenol compound having a viscosity of 3,000 centipoises or less as measured at 25° C. and an abrasion-resistant material having a particle size of 200 μm or less and a particle size distribution represented by a uniformity coefficient of 10 or above and a curvature coefficient of 10 or below as determined from a cumulative particle size curve wherein the proportion of a fraction of said abrasion-resistant material having a particle size of 10 μm or less to the total abrasion-resistant material is 15–50% by weight and the proportion of a fraction of said abrasion-resistant material having a particle size of 1 μm or less to the total abrasion-resistant material is 30% by weight or less, wherein the ratio (by weight) of the polyfunctional aminoepoxy resin to the abrasion-resistant material (polyfunctional aminoepoxy resin:abrasion-resistant material) in the epoxy resin composition is in the range of from 15:85 to 40:60.

The epoxy resin composition for forming the trowel surface 3 is the same as the above-mentioned epoxy resin composition for forming trowel matrix 2, except that the epoxy resin composition for forming trowel surface 3 contains an abrasion-resistant material in place of the metal powder used in the epoxy resin composition for forming trowel matrix 2. The items common to both the epoxy resin compositions are not described herein.

As the abrasion-resistant material, alumina, silica, silicon carbide, mullite, zirconium, silicon nitride or boron nitride can be used successfully in the form of a single material or a mixture of a plurality of them.

As has been mentioned above, trowel surface 3 is formed from an epoxy resin composition containing a finely powdered abrasion-resistant material (preferably alumina because of the superior mechanical strength thereof), due to which there can be formed a rotary trowel having a much increased abrasion resistance and a prolonged life-time of the trowel itself and retaining a smoothness of trowel surface. Further, the trowel can be formed by molding using a casting mold, and even in cases where a trowel surface carrying complicated patterns is to be prepared, such a trowel surface can be formed easily and exactly.

In the rotary trowel 1 for use in the molding of ceramics of the present example, the trowel matrix 2 is also formed from an epoxy resin composition as has been described above.

However the material constituting the matrix is not limited to epoxy resin composition, but a wide variety of rotary trowels for use in the molding of ceramics in which the trowel matrix is formed from a metallic material such as iron, aluminum or the like are also included in the scope of the present invention; provided that the use of an epoxy resin composition containing a metal powder as a material for forming the trowel matrix facilitates the manufacture of the rotary trowel.

If desired, a powdered aluminum having a particle size of not smaller than 1 mm and not greater than 10 mm may be incorporated into the epoxy resin composition for forming the trowel matrix in a proportion (epoxy resin composition-:powdered aluminum having a particle size of not smaller than 1 mm and not greater than 10 mm, by weight) of from 1:0.5 to 1:3. By adding such a powdered aluminum, aluminum content in the trowel matrix can markedly be increased, heat conductivity of trowel matrix can be enhanced, the period of time necessary for heating prior to use can be shortened, and the occurrence or crack of the trowel matrix caused by the difference in heat conductivity between trowel matrix and solidly binding means 21 can be prevented.

Further, it is preferable to incorporate a self-lubricating material into the epoxy resin composition for forming trowel surface and/or trowel matrix. By the addition thereof, surface smoothness can be improved additionally, and the demolding property can be improved. As said self-lubricating material, graphite, molybdenum disulfide, fluororesin, mica and talc can be used successfully.

Figure 8:
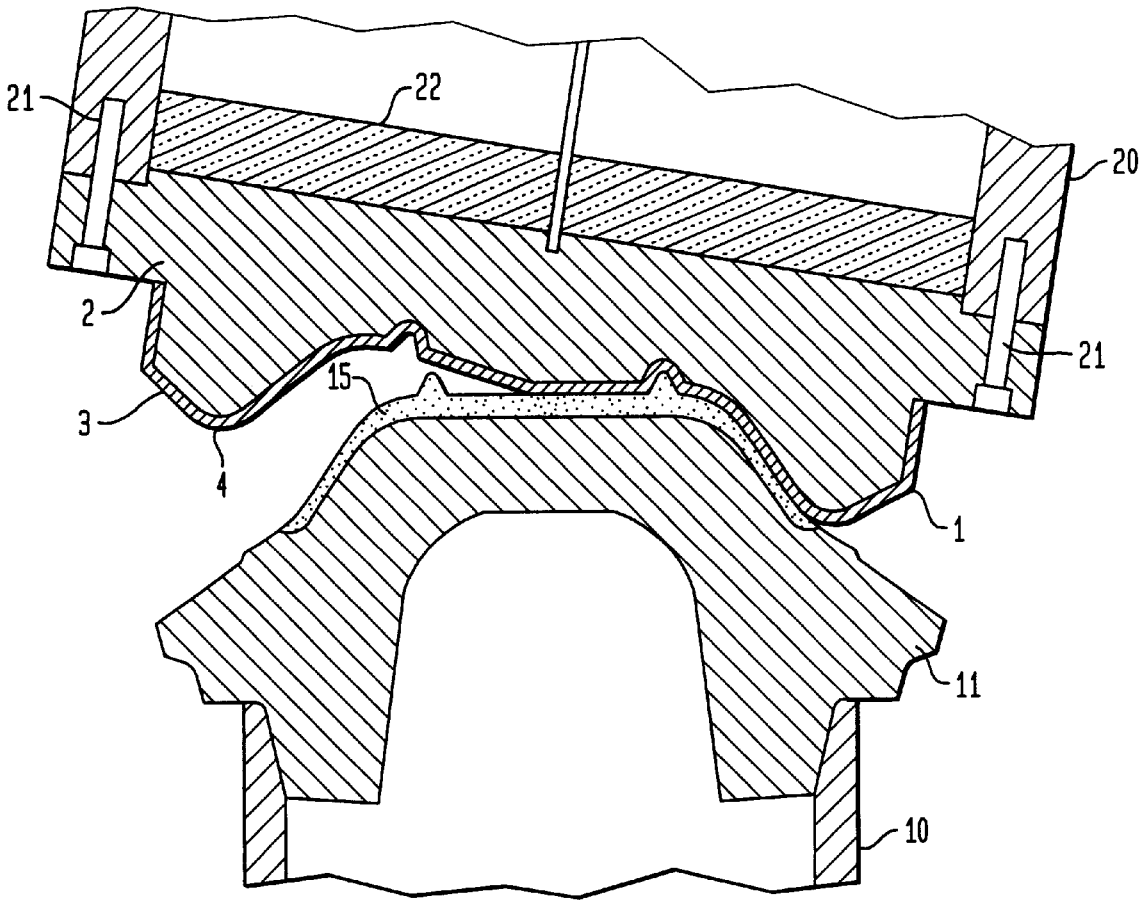
FIG. 8 is a vertical end outlined view illustrating the method for using the rotary trowel for use in the molding of ceramics of the present invention.

Next, an example of the use of the rotary trowel for use in the molding of ceramics according to the present invention will be explained below with reference to FIG. 8. When the rotary trowel for use in the molding of ceramics 1 of the present example is put to use, the rotary trowel for use in the molding ceramics 1 is fixed onto a rotary driving means 20 via a solidly binding means 21. The rotary driving means 20 is provided with a heater 22, by means of which the rotary trowel 1 is heated to a temperature of 80–120° C.

On the other hand, a gypsum mold 11 is fixed above a jigger 10, and a raw clay composition is fed into the gap between the gypsum mold 11 and the rotary trowel 1. By rotating the jigger 10 at a speed of 300 rpm, the rotary trowel 1 is rotated at 270 rpm and the raw clay composition 15 is calendered. Subsequently, the speed of the rotary trowel is elevated to 300 rpm, and finally the rotation of rotary trowel 1 is synchronized with the rotation of jigger 10, and the rotations of both the rotary trowel and jigger are stopped. By this procedure, one ceramic product is formed and, at the same time, a fine pattern is formed on the surface of said ceramic product by the pattern 5 existing on the trowel surface 2 of the rotary trowel 1.

The rotary trowel for use in the molding of ceramics according to the present invention is not limited to that used for the hot trowel method as mentioned in the present example, but the rotary trowel of the invention can successfully be used also for other rotary trowel type calendering processes, because the rotary trowel of the present invention can form a fine pattern on the trowel surface easily and exactly and the surface thereof retains a high abrasion resistance (durability) and a surface smoothness.

Next, a method for producing the rotary trowel 1 for use in the molding of ceramics of the present invention will be explained with reference to FIGS. 3 to 7. The rotary trowel 1 for use in the molding of ceramics according to the present example is produced by a method comprising a step of preparing a casting mold 6, a step of coating the inner surface of the casting mold 6 with an epoxy resin composition containing an abrasion-resistant material to form a trowel surface 3, a step of pouring an epoxy resin composition containing a metal powder into the inner space of the casting mold 6 to form a trowel matrix 2, a step of demolding the cast trowel surface 3 and trowel matrix 2 from the casting mold 6, and a step of heating and curing the trowel surface 3 and the trowel matrix 2. These steps will be explained below in detail successively.

Figure 4:
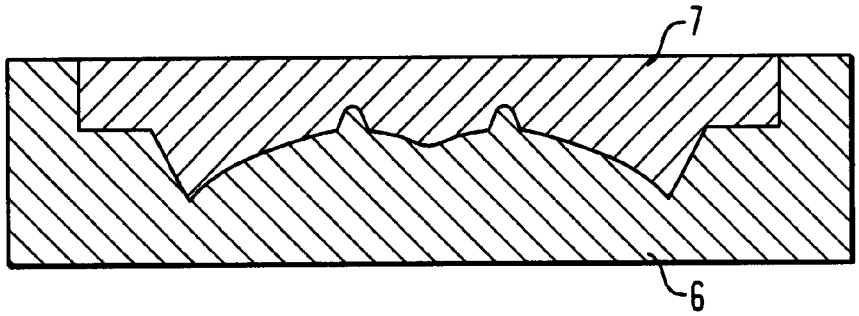
FIG. 4 is a schematic view illustrating one step in the method for producing the rotary trowel for use in the molding of ceramics of the present invention.

In the step of preparing casting mold 6, a master model 7 (FIG. 3) having the shape shown in FIGS. 1 and 2 is prepared, and casting mold 6 is prepared from the master model 7 as shown in FIG. 4.

Figure 5:
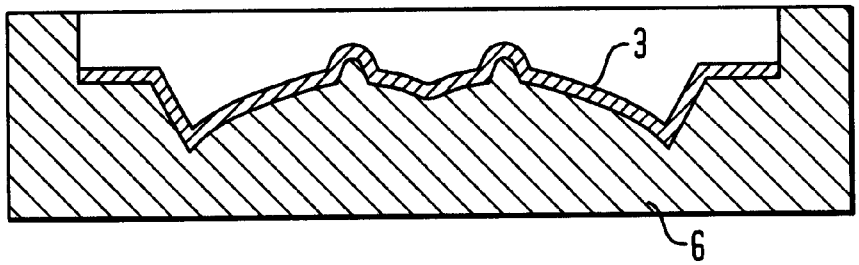
FIG. 5 is a schematic view illustrating one step in the method for producing the rotary trowel for use in the molding of ceramics of the present invention.

Subsequently, the master mode 7 is taken off to form casting mold 6, and the inner surface of casting mold 6 is coated with an epoxy resin composition containing an abrasion-resistant material by means of a brush or the like to form trowel surface 3 as shown in FIG. 5. The epoxy resin composition used herein comprises a polyfunctional aminoepoxy resin which is a polyglycidyl derivative of an aminophenol having a viscosity of 3,000 centipoises or less as measured at 25° C. and an abrasion-resistant material (alumina was used in the present example) having a particle size of 200 μm or less and a particle size distribution represented by a uniformity coefficient of 10 or above and a curvature coefficient of 10 or below as determined from a cumulative particle size curve, wherein the proportion of a fraction of said abrasion-resistant material having a particle size of 10 μm or less to the total abrasion-resistant material is 15–50% by weight and the proportion of a fraction of said abrasion-resistant material having a particle size of 1 μm or less to the total abrasion-resistant material is 30% by weight or less, and the ratio (by weight) of the polyfunctional aminoepoxy resin to the abrasion-resistant material (polyfunctional aminoepoxy resin:abrasion-resistant material) in the epoxy resin composition is in the range of from 15:85 to 40:60.

In this step, the pattern provided on the trowel surface 3 is formed from the above-mentioned epoxy resin composition containing an abrasion-resistant material. After cure, the pattern becomies excellent in abrasion resistance (durability) and smoothness.

Figure 6:
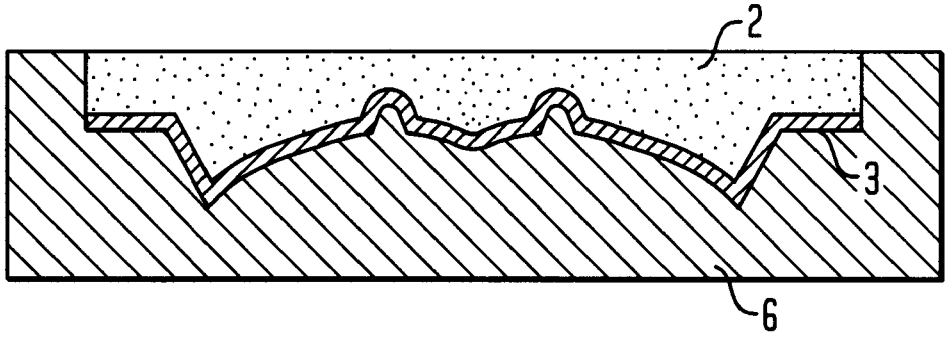
FIG. 6 is a schematic view illustrating one step in the method for producing the rotary trowel for use in the molding of ceramics of the present invention.

Thereafter, as shown in FIG. 6, an epoxy resin composition containing a metal powder is poured into the inner space of the casting mold 6 to form trowel matrix 2. The epoxy resin composition used herein comprises a polyfunctional aminoepoxy resin which is a polyglycidyl derivative of an aminophenol having a viscosity of 3,000 centipoises or less as measured at 25° C. and a metal powder having a particle size of 200 μm or less and a particle size distribution represented by a uniformity coefficient of 10 or above and a curvature coefficient of 10 or below as determined from a cumulative particle size curve, wherein the proportion of a fraction of said metal powder having a particle size of 10 μm or less to the total metal powder is 15–50% by weight and the proportion of a fraction of said metal powder having a particle size of 1 μm or less to the total metal powder is 30% by weight or less, and the ratio (by weight) of the polyfunctional aminoepoxy resin to the metal powder (polyfunctional aminoepoxy resin:metal powder) in the epoxy resin composition is in the range of from 15:85 to 40:60. In the present example, aluminum powder having a superior heat conductivity was used as said metal powder.

In the step of heating and curing the trowel surface 3 and trowel matrix 2, the trowel surface 3 and the trowel matrix 2 are heated and cured together with the casting mold 6 by means of a heating means such as heater or the like at about 150° C. for a necessary period of time. In the present example, the temperature was gradually elevated from 60° C. to 150° C. and then curing was carried out over a period of about 10 hours.

Figure 7:
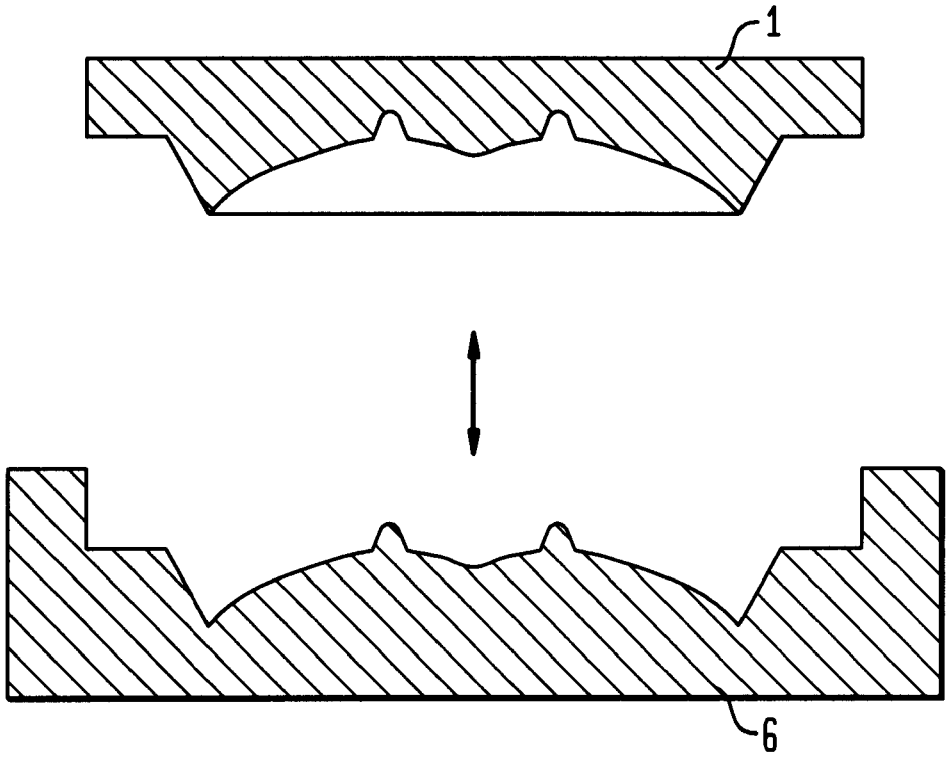
FIG. 7 is a schematic view illustrating one step in the method for producing the rotary trowel for use in the molding of ceramics of the present invention.

In the step of demolding the trowel matrix 2 and trowel surface 3 from the casting mold 6, demolding is carried out by the use of a demolding agent as shown in FIG. 7 to obtain rotary trowel 1 for use in the molding of ceramics according to the present invention Both the epoxy resin compositions constituting the trowel surface 2 and the trowel matrix 3 are excellent in chemical resistance, so that surfaces thereof are not corroded by the demolding agent.

According to the invention claimed in claim 1 to claim 3, there can be produced a rotary trowel retaining a high abrasion resistance and smoothness of the trowel surface and easily and exactly moldable even when the trowel surface has a complicated pattem.

According to the invention claimed in claim 4, a trowel surface retaining high abrasion resistance and smoothness can be produced easily and exactly even in cases where the trowel surface must have a complicated pattern, and a trowel matrix excellent in heat resistance and heat conductivity can be produced easily.

According to the invention claimed in claim 5, there can be obtained a rotary trowel for use in the molding of ceramics which is more excellent in heat conductivity and lighter in weight.

According to the invention claimed in claim 6, the period of time necessary for heating prior to use of the rotary trowel can be more shortened.

According to the invention claimed in claim 7 and claim 8, smoothness of the surface can be more improved and demoldability of the composition can be improved.

According to the invention claimed in claim 9, a cold cure becomes practicable and the period of time necessary for cure can be shortened.

According to the invention claimed in claim 10, a rotary trowel for the molding of ceramics exhibiting the effect of claim 4 can be produced easily.

What is claimed is:

1. A rotary trowel for use in the molding of ceramics comprising a trowel matrix and a trowel surface provided on said trowel matrix so as to make contact with a raw clay composition and calender the raw clay composition, said trowel matrix containing a metal powder and said trowel surface containing an abrasion-resistant material, characterized in that said trowel is formed by preparing a casting mold, coating the inner surface of said casting mold with an epoxy resin composition containing an abrasion-resistant material to form a trowel surface, pouring an epoxy resin composition containing a metal powder into the inner space of the casting mold to form a trowel matrix, and demolding the cast trowel surface and trowel matrix from the casting mold.

2. A rotary trowel for use in the molding of ceramics comprising a trowel matrix and a trowel surface provided on said trowel matrix so as to make contact with a raw clay composition and calender said raw clay composition, said trowel surface being formed from an epoxy resin composition comprising a polyfunctional aminoepoxy resin which is a polyglycidyl derivative of an aminophenol having a viscosity of 3,000 centipoises or less as measured at 25° C. and an abrasion-resistant material having a particle size of 200 μm or less and a particle size distribution represented by a uniformity coefficient of 10 or above and a curvature coefficient of 10 or below as determined from a cumulative particle size curve, wherein proportion of a fraction of said abrasion-resistant material having a particle size of 10 μm or less to the total abrasion-resistant material is 15–50% by weight proportion of a fraction of said abrasion-resistant material having a particle size of 1 μm or less to the total abrasion-resistant material is 30% by weight or less, and the ratio (by weight) of said polyfunctional aminoepoxy resin to said abrasion-resistant material (polyfunctional aminoepoxy resin:abrasion-resistant material) in said epoxy resin composition is in the range of from 15:85 to 40:60.

3. The rotary trowel for use in the molding of ceramics claimed in claim 1, wherein said abrasion-resistant material is alumina, silica, silicon carbide, mullite, zirconium, silicon nitride or boron nitride.

4. The rotary trowel or use in the molding of ceramics claimed in claim 3, wherein said metal powder is powdered aluminum.

5. The rotary trowel for use in the molding of ceramics claimed in claim 3, wherein a powdered aluminum having a particle size of not smaller than 1 mm and not greater than 10 mm is compounded into said epoxy resin composition constituting said trowel matrix in a proportion (epoxy resin composition:powdered aluminum, by weight) of from 1:0.5 to 1:3.

6. The rotary trowel for use in the molding of ceramics claimed in claim 1, wherein a self-lubricating material is compounded into at least one of the epoxy resin composition constituting said trowel surface and the epoxy resin composition comprising said trowel matrix.

7. The rotary trowel for use in the molding of ceramics claimed in claim 6, wherein said self-lubricating material is graphite, molybdenum disulfide, fluororesin, mica or talc.

8. The rotary trowel for use in the molding of ceramics claimed in claim 1, wherein at least one of a curing agent and a curing accelerator is compounded into at least one of the epoxy resin composition forming said trowel surface and the epoxy resin composition comprising said trowel matrix.

9. A method for producing a rotary trowel comprising the steps of:

preparing a casting mold from a master model, forming a trowel surface by coating the inner surface of said casting mold with a first epoxy resin composition comprising a polyfunctional aminoepoxy resin which is a polyglycidyl derivative of an aminophenol having a viscosity of 3,000 centipoises or less as measured at 25° C. and an abrasion-resistant material having a particle size of 200 $\mu$m or less and a particle size distribution represented by a uniformity coefficient of 10 or above and a curvature coefficient of 10 or below as determined from a cumulative particle size curve, wherein proportion of a fraction of said abrasion-resistant material having a particle size of 10 $\mu$m or less to the total abrasion-resistant material is 15–50% by weight, proportion of a fraction of said abrasion-resistant material having a particle size of 1 $\mu$m or less to the total abrasion-resistant material is 30% by weight or less, and ratio (by weight) of said polyfunctional aminoepoxy resin to said abrasion-resistant material in said first epoxy resin composition is in the range of from 15:85 to 40:60;

forming a trowel matrix by casting a second epoxy resin composition into the inner space of said casting mold, wherein said second epoxy resin composition comprises a polyfunctional aminoepoxy resin which is a polyglycidyl derivative of an aminophenol having a viscosity of 3,000 centipoises or less as measured at 25° C. and a metal powder having a particle size of 200 $\mu$m or less and a particle size distribution represented by a uniformity coefficient of 10 or above and a curvature coefficient of 10 or below as determined from a cumulative particle size curve, wherein proportion of a fraction of said metal powder having a particle size of 10 $\mu$m or less to the total metal powder is 15–50% by weight, proportion of a fraction of said metal powder having a particle size of 1 $\mu$m or less to the total metal powder is 30% by weight or less, and ratio (by weight) of said polyfunctional aminoepoxy resin to said metal powder in said second epoxy resin composition is in the range of from 15:85 to 40:60;

demolding said trowel surface and said trowel matrix from said casting mold, and heating and curing said trowel surface and said trowel matrix.

10. The rotary trowel for use in the molding of ceramincs claimed in claim 2, wherein said abrasion-resistant material is alumina, silica, silicon carbide, mullite, zirconium, silicon nitride or boron nitride.

11. The rotary trowel for use in the molding of ceramics claimed in claim 4, wherein the powdered aluminum having a particle size of not smaller than 1 mm and not greater than 10 mm is compounded into said epoxy resin composition constituting said trowel matrix in a proportion (epoxy resin composition: powdered aluminum, by weight) of from 1:0.5 to 1:3.

* * * * *